US012416219B1

(12) United States Patent
Mueller et al.

(10) Patent No.: US 12,416,219 B1
(45) Date of Patent: Sep. 16, 2025

(54) FRANGIBLE WELL STRING PORT DEVICE

(71) Applicant: PACKERS PLUS ENERGY SERVICE INC., Calgary (CA)

(72) Inventors: Mitchell Mueller, Tomball, TX (US); Andrew Cayson, Cypress, TX (US); Javier Bolivar, Tomball, TX (US); Matthew Skinner, Edmonton (CA)

(73) Assignee: Packers Plus Energy Service Inc., Calgary (CA)

( * ) Notice: Subject to any disclaimer, the term of this patent is extended or adjusted under 35 U.S.C. 154(b) by 21 days.

(21) Appl. No.: 18/445,905

(22) Filed: Mar. 18, 2024

(51) Int. Cl.
*E21B 34/06* (2006.01)
*E21B 41/00* (2006.01)

(52) U.S. Cl.
CPC ..... *E21B 34/063* (2013.01); *E21B 41/0078* (2013.01)

(58) Field of Classification Search
CPC ..... E21B 34/06
See application file for complete search history.

(56) References Cited

U.S. PATENT DOCUMENTS 5,947,204 A 9/1999 Barton
10,030,472 B2 * 7/2018 Fripp ..... E21B 43/12
11,988,066 B2 * 5/2024 Loehken ..... E21B 43/11855
2014/0311752 A1 10/2014 Streich et al.
2017/0321518 A1 11/2017 Hiorth et al.
2020/0291742 A1 * 9/2020 Woiceshyn ..... E21B 34/063

FOREIGN PATENT DOCUMENTS

CA 2996800 A1 * 5/2019 ..... E21B 34/063
WO 2017/095495 A1 6/2017

OTHER PUBLICATIONS

International Search Report and Written Opinion of the International Searching Authority, mailed Jun. 12, 2024, from companion application PCT/US2024/000006 filed Mar. 18, 2024.

* cited by examiner

*Primary Examiner* — Aaron L Lembo
(74) *Attorney, Agent, or Firm* — Prince Lobel Tye LLP

(57) ABSTRACT

The invention comprises a novel nozzle for use in wellbore tubing strings. The nozzle has an annular cylindrical nozzle body surrounding a frangible material. The frangible material is bonded to the nozzle body forming a seal. When deployed in a well, the nozzle prevents fluidic communication between the inside of the tubing string and an annulus of the well. A further component of the nozzle may comprise a stress riser that, when actuated, breaks the frangible material, allowing fluidic communication between the inside of the tubing string and the annulus of the well. Subsequent well operations (e.g., fracturing or production) may then be conducted.

13 Claims, 4 Drawing Sheets

FRANGIBLE WELL STRING PORT DEVICE

CROSS-REFERENCES TO RELATED APPLICATIONS

This application claims priority to U.S. provisional patent application Ser. No. 63/451,820, the contents of which are incorporated herein by reference in its entirety.

TECHNICAL FIELD

The present application relates generally to wellbore perforation/production port devices. More particularly, the present application relates to wellbore perforation and/or production valves including frangible frac valve components for well completion using same.

BACKGROUND OF THE INVENTION

Well treatment strings for staged well treatment operations typically carry tools to create a plurality of isolated zones within a well and allow selected fluidic access to each such isolated zone. For example, a treatment string may comprise a series of ported subs, each with one or more ports connecting the inner bore of the string to a subset of the well formation corresponding to an isolated zone, where each sub can be individually activated to allow stimulation fluids (e.g., acid, gelled acid, gelled water, gelled oil, CO.sub.2, nitrogen and/or proppant laden fluids) or other fluids to be introduced through its ports to the well formation for the given isolated zone.

Problems involving ported subs are known. One such problem is that ports may open prematurely or fail, allowing unwanted and deleterious fluidic communication between a tubing string and surrounding annulus in a sub prior to its activation. Another problem with existing ported subs involves activation of the port. Many existing ported subs are activated by devices, e.g., balls or darts, that must engage a seat within each sub to active the sub to open ports therein, for example. The seats within each sub introduce flow restrictions that must be compensated for, for example by milling out each sub prior to production.

Various means have been devised to prevent unwanted fluid communication through a port prior to its activation, such as above-mentioned sliding ball-actuated sleeves and degradable or elastomeric plugs. These prior art devices are suboptimal in many applications, however. What is needed is a more robust, cost-effective, and flexible actuation system.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure may contain terms such as "upstream," "downstream," "upper," and "lower" to convey relative position within a wellbore. Those of ordinary skill in the art will appreciate that such terms are used with respect to an orientation in which "upstream" is toward a wellhead and "downstream" is toward a toe end, which orientation further may be vertical, horizontal, or otherwise.

To simplify the design of ports or frac valves (e.g., quickports, fracports etc.) the present invention creates a port between the tubing and annulus that does not require the use of elastomeric seals or sliding sleeve or ball seats to expose. In particular embodiments, the port may take the form of a nozzle.

The present invention uses a frangible material (e.g., glass) to fill a nozzle that is triggered by the passing of an activator. Once triggered, the frangible material is fractured or shattered, allowing fluidic communication from the tubing to the annulus.

The invention further simplifies a port or frac valve by incorporating this feature into something akin to a coupling. This can allow for the same functionality of a Quickport (for example) without the common expenses of "sleeve activated" style tools. It also has the potential to provide a tool with no elastomeric seals that can exceed casing performance.

Increasing or decreasing the thickness of the frangible (e.g., glass) material may change the activation load and pressure holding capability of the port or frac valve, allowing for greater flexibility in deployment.

The invention also facilitates the creation of a force high enough to simulate a "shear" event to indicate on surface that the feature has functioned properly.

In a first embodiment, the present disclosure relates to a wellbore sub comprising one or more frangible frac ports. A frangible frac port may comprise a nozzle spanning a wellbore sub from the interior of a tubing string (for example) to an annulus surrounding the tubing string. The nozzle body may comprise a frangible material, e.g., glass. The nozzle body may further comprise (but need not comprise) a stress riser within or proximate to the frangible material. The stress riser may be partially or completely situated within the frangible material. For example, the stress riser may be a metallic object that spans the length of the nozzle body through or adjacent to the frangible material. The nozzle body may further comprise an actuator, e.g., a trigger, in contact with the stress riser that, when actuated, causes the stress riser to break, shatter, or perforate the frangible material thereby creating an opening through the nozzle so that the interior of the tubing string (for example) is then in fluidic communication with the annulus. The actuator may comprise a part of the stress riser. The actuator may be actuated by a passing device (e.g., a ball or dart) making contact with it or otherwise interacting with and activating it. Conventional well operations (e.g., fracturing or production) could then be conducted within the sub.

In a second embodiment derived from the first embodiment, the nozzle may further comprise shielding between the frangible material and the outside (proximate the annulus) of the nozzle, the shielding for preventing debris from outside of the tubing string from making contact with (and potentially damaging) the frangible material prior to actuation of the stress riser.

In a third embodiment, the frangible material may be disposed directly within the wall of a sub, i.e., not within a nozzle.

In each of the foregoing embodiments, a stress rise may not be included. In the absence of a stress riser, a passing device (e.g., a ball or dart) may directly induce breakage or perforation of the frangible material.

BRIEF DESCRIPTION OF DRAWINGS

The drawings accompanying and forming part of this specification are included to depict certain aspects of the present invention. A clearer impression of the invention, and of the components and operation of systems provided with the present invention, will become more readily apparent by referring to the exemplary, and therefore non-limiting, embodiments illustrated in the drawings, wherein identical reference numerals designate the same components. Note that the features illustrated in the drawings are not necessarily to scale.

DETAILED DESCRIPTION OF THE INVENTION

Figure 1:
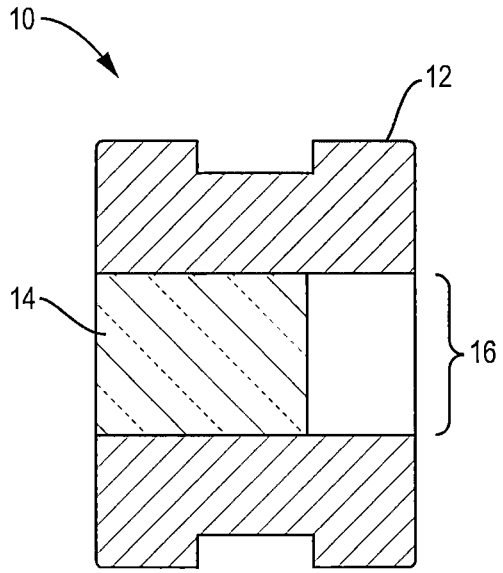
FIG. 1 depicts a bisectional view of a nozzle in accordance with one embodiment of the present invention.

FIG. 1 depicts a sub port nozzle 10 according to a first embodiment of the present invention. The nozzle 10 comprises an annular cylindrical nozzle body 12 including a hollow passage 16 (which may also be cylindrical) therethrough. A frangible filler component 14 occupies the hollow passage 16 of the nozzle body 12 in sealing engagement therewith. As explained further below, the frangible filler component 14 may occupy all, or only a part of the hollow passage, the only requirement being that it must form a seal within the nozzle body 12, the nozzle body 12 and frangible filler component 14 effectively creating a plug through a sub (see FIG. 4).

Figure 2:
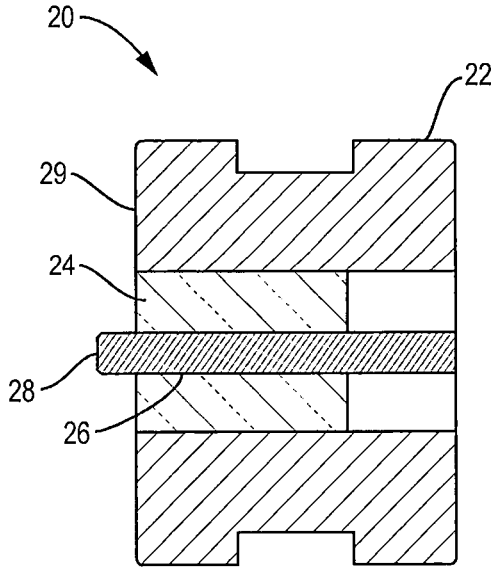
FIG. 2 depicts a bisectional view of a nozzle including a stress riser in accordance with another embodiment of the present invention.

A second embodiment is depicted in FIG. 2. In this FIG. 2 a sub port nozzle 20 comprises a nozzle body 22 and a frangible filler component 24, which may be the same or similar to that in the first embodiment. (Like components are otherwise the same as depicted in FIG. 1, with reference numerals incremented by 10). In this embodiment, a stress riser 26 is positioned within the frangible filler component 24. The stress riser 26 may be a metallic or metalloid bar extending at least partially through the frangible filler component 24 in sealing engagement therewith. Preferably, a portion of the stress riser 28 extends beyond an inner surface 29 of the nozzle 10. As with the first embodiment, the nozzle 20 effectively creates a plug in a wellbore sub (see FIG. 4).

Figure 3:
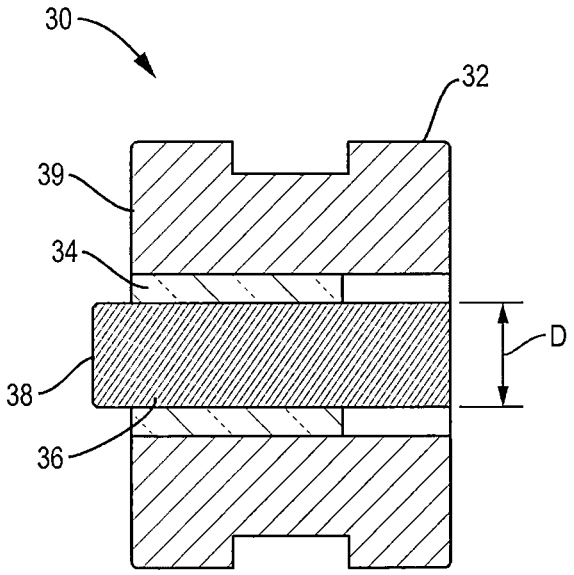
FIG. 3 depicts a bisectional view of a nozzle including a stress riser in accordance with yet another embodiment of the present invention.

A third embodiment is depicted in FIG. 3. This embodiment is similar to that depicted in FIG. 2, except the stress riser 36 is larger (e.g., it has a larger diameter D. (Like components are otherwise the same as depicted in FIG. 2, with reference numerals incremented by 10).

Figure 4:
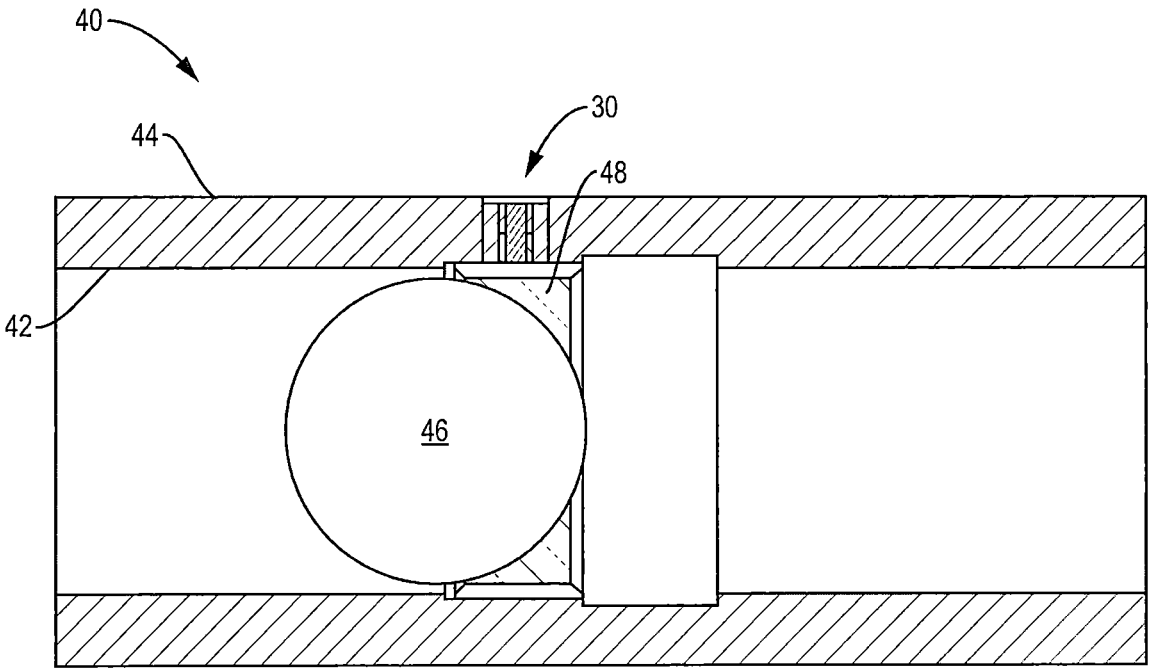
FIG. 4 depicts a bisectional view of a wellbore sub including a nozzle and actuating components according to an embodiment of the present invention.

Operation of nozzles 10, 20, 30 will now be explained with reference to FIG. 4. A wellbore sub (e.g., tool) 40 includes one or more nozzles 10, 20, 30 extending between an inner surface 42 and an outer surface 44. In FIG. 4, nozzle 30 is depicted, but either of nozzles 10 or 20 could replace nozzle 30 without departing from the spirit or scope of the present invention. In addition, while only one nozzle 30 is depicted in FIG. 4 to simplify explanation, the invention contemplates that more than one nozzle may be positioned within sub 40 as would be apparent to those of ordinary skill in the art. As depicted in FIG. 4, nozzle 30 forms a seal within sub 40 (i.e., the frangible component 14, 24, 34 is intact). When the zone in which sub 40 is ready for activation, a device 46 (a ball in this exemplary embodiment) may be sent downwell into sub 40. As the device 46 passes by nozzle 30 it contacts a trigger 48. In turn, trigger 48 induces breakage in the frangible component 14, 24, 34 (e.g., shattering or puncturing frangible component 14, 24, 34), thereby unplugging nozzle 10, 20, 30 and creating fluidic communication between the inner surface 42 and outer surface 44 of the sub 40. Well operations (e.g., fracturing or production) may subsequently be performed.

While FIG. 4 depicts the device 46 as a ball, the invention is not limited to the device comprising a ball. For example, device 46 may comprise a dart or any other device known or to be introduced in the future that may activate the trigger 48. In addition, trigger 48 is an optional component of the invention. Instead, device 46 may contact a portion 28, 38 of stress riser 26, 36 (see FIGS. 2 and 3) and induce breakage of frangible component 24, 34 (e.g., shattering or puncturing frangible component 24, 34) in that manner.

Figure 5:
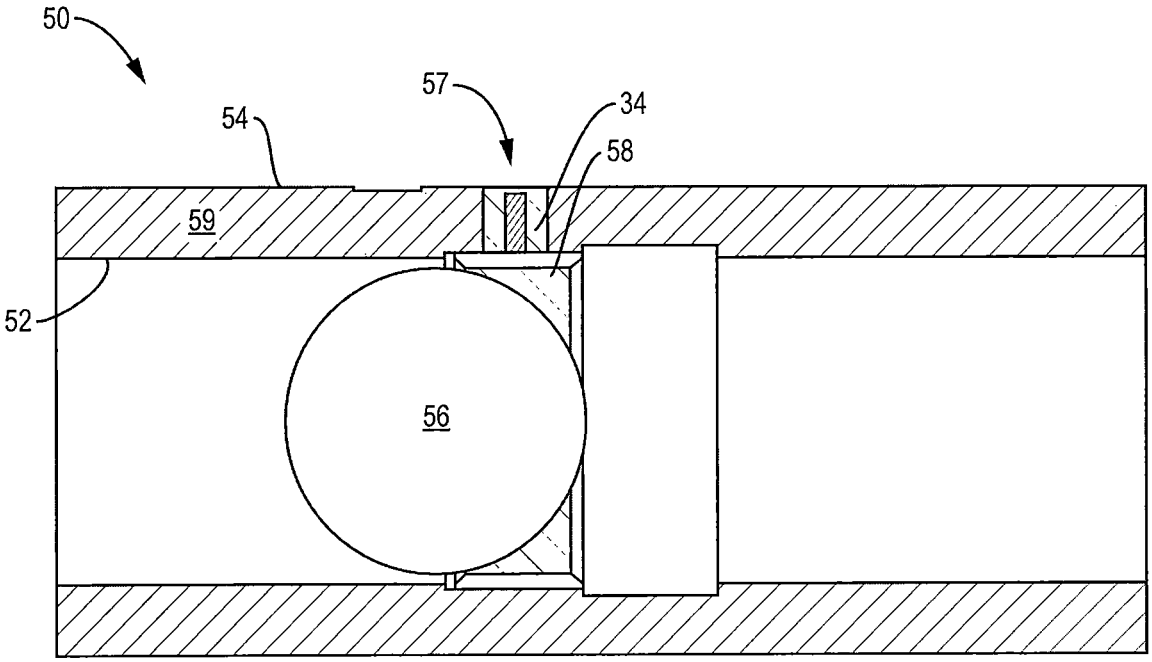
FIG. 5 depicts a bisectional view of a wellbore sub including a frangible component (e.g., a port) and actuating components according to an embodiment of the present invention.

Each of the above embodiments included a nozzle 10, 20, 30. However, nozzle body 10, 20, 30 may be excluded. In an alternative embodiment depicted in FIG. 5, frangible component 34 is incorporated directly into the wall 59 of sub 50 in sealing relation therewith. In this embodiment, when device 56 contacts trigger 58 and induces breakage of frangible component 34, it unseals (i.e., creates) a port 57 through wall 59. Subsequent well operations (e.g., fracturing or production) may then be performed. Alternatively, trigger 58 may be omitted from this embodiment as well. In this case, device 56 may contact inner end 38 of stress riser 36 directly (see FIG. 3), thereby inducing breakage of frangible component 34 as with the previous embodiment. Additionally, although stress riser 36 is depicted in this embodiment, a different stress riser (e.g., stress riser 26) may be substituted, or no stress riser may be present at all (e.g., a part of device 56 may directly contact and fracture frangible component 34.

Having described broad aspects of the present invention, further details are now provided.

Nozzle material candidates include Inconel, Cobalt Chrome Alloys like Stellite and ideally tungsten carbide.

Glass-to-metal seal performance is improved and tool cost and complexity (like elastomeric seals, sliding sleeves and the connections required to build tools of this typical construction) is reduced. The invention also allows for meeting or exceeding base pipe burst/collapse ratings at temperatures up to approximately 400° F.

The invention may also include a mechanically triggered port. There are many other applications where a feature as described above may be useful to seal off a hydraulic or atmospheric chamber that is then triggered to function by acting on the frangible material (e.g., glass). The glass-to-metal seal provides a reliable seal design that can be overcome by stressing the glass. The violation of the glass then allows another feature of a tool to function (i.e. an atmospheric chamber is enabled to provide force to some tool function or hydrostatic pressure is exposed to a previously isolated piston etc.). This application would likely result in varying the glass thickness to provide a known/predictable activation force and the port size would vary based on the requirements of that tool's specific functionality.

Directly bonding glass into a downhole coupling. This embodiment includes plugging a port in the housing with a frangible material (e.g., glass) without including a nozzle. This allows the ability to add a "port" geometry directly into an existing downhole coupling.

Uses of the Invention May Include:

Multi-point Injection (applications akin to plug and perf with multiple shots/clusters per "stage"). In this scenario, nozzle size (orifice diameter after frangible material is violated) will simulate a perf shot with a diameter approx. ⅜". Nozzle sizes may vary over the length of a "stage" to ensure an even distribution of treatment across the stage. Nozzle material offers another advantage by providing nozzles with higher erosion resistance than a perf shot in casing to reduce perf erosion currently experienced in the industry.

Single Point Injection (akin to a single ball-activated stimulation and production port inserted at a stage). The nozzle size may be increased to a larger geometry to provide a larger flow area to reduce potential for erosion/pressure-drop at the port housing. For example, nozzle ddd may grow to 0.75" diameter and multiple nozzles may be installed in housing to meet base pipe flow area needs. The nozzle material may be similar, if not identical, to the multi-point design described above. Also, glass-to-metal seal performance may match or exceed base pipe performance for the same reasons given above.

With respect to the above embodiments, the thickness of the frangible material will vary to provide different pressure ratings and/or different break force signatures. Nozzle size may also vary based on the application of the device to provide or reduce a pressure drop. Nozzle material will most likely be controlled/limited by the frangible-material-to-metal seal design. Frangible material composition will likely (but not necessarily) remain constant to provide the stresses needed to become a reliable "sealing" feature. Nozzle shape may vary with orifice size. Frangible-material-to-metal embodiments may be able to facilitate downhole coupling without the use of a nozzle. In addition, a variety of "triggering" geometries exist such as directly incorporating a breaker into the glass, having a mating component's relative motion break the glass, etc.

In a particular embodiment, a glass-to-metal seal design relies on the high internal stresses in the glass to create a high-temperature/high-pressure seal in the nozzle orifice. A nozzle body may contain the frangible material and an activator. Once triggered the frangible material may shatter and the nozzle then controls flow from tubing to annulus (or vice versa in a production tool). An activating member causes the frangible material to break by a passing activator (for example).

Materials that may be used for the frangible material (e.g., glass) in exemplary embodiments barium alkali. Materials that may be used for the prototype nozzle included Inconel X750. Materials of various embodiments may include cobalt chrome, tungsten carbide blends, and ceramics for high performance erosion-resistant materials.

The invention claimed is:

1. A nozzle configured to facilitate fluid communication between a tubing string and an annulus in a well outside of the tubing string, comprising:

a nozzle body having a first length;

the nozzle body including a hollow passage through the first length;

a frangible material positioned within the hollow passage; and the frangible material forming a seal within the hollow passage.

2. The nozzle of claim 1, further comprising:

the frangible material occupies substantially the entirety of the hollow passage.

3. The nozzle of claim 1, further comprising:

the nozzle body is substantially cylindrical along the first length; and the hollow passage is substantially cylindrical along the first length.

4. The nozzle of claim 3, further comprising:

a stress riser positioned within the hollow passage, the stress riser configured to fracture the frangible material when acted upon by a force.

5. The nozzle of claim 4, further comprising:

the stress riser having a second length, a portion of which extends beyond a first end of the nozzle body.

6. The nozzle of claim 4, further comprising:

the stress riser is positioned within the frangible material.

7. The nozzle of claim 1, further comprising:

the nozzle body comprises one or more of a nickel-chromium alloy, a cobalt-chromium alloy, and a tungsten carbide.

8. The nozzle of claim 1, further comprising:

the frangible material comprises one of a barium alkali glass and a soda lime glass.

9. A port configured to facilitate fluid communication between an inside and an outside of a tubular body within a wellbore, comprising:

a wellbore sub comprising a wall with an inner surface and an outer surface;

the wellbore sub further comprising a void within the wall extending from the inner surface to the outer surface; and a frangible material positioned within the void in sealing arrangement with the wall.

10. The port of claim 9, further comprising:

the frangible material substantially filling the void from the inner surface of the wall to the outer surface of the wall.

11. The port of claim 9, further comprising:

a stress riser positioned within the void in contact with the frangible material.

12. The port of claim 9, further comprising:

the frangible material comprising one of a barium alkali glass and a soda lime glass.

13. The port of claim 9, further comprising:

at least a portion of the wall proximate the void comprising one or more of a nickel-chromium alloy, a cobalt-chromium alloy, and a tungsten carbide.

* * * * *